United States Patent [19]

Hayes

[11] 4,036,205

[45] July 19, 1977

[54] FIREPLACE STOVE

[75] Inventor: Robert William Hayes, Avon, Conn.

[73] Assignee: Hayes-Te Equipment Corporation, Unionville, Conn.

[21] Appl. No.: 573,872

[22] Filed: May 2, 1975

[51] Int. Cl.[2] ..... F24C 15/30

[52] U.S. Cl. ..... 126/126; 126/137; 126/140

[58] Field of Search ..... 126/126, 123, 138, 25 R, 126/25 A, 137, 120, 121, 336, 140, 202, 304 R, 304 A

[56] References Cited

U.S. PATENT DOCUMENTS

| | | | |
|---|---|---|---|
| 266,661 | 10/1882 | Tracy | 126/126 |
| 573,793 | 12/1896 | Perrault et al. | 126/137 |
| 804,106 | 11/1905 | Douglass | 126/126 |
| 996,703 | 7/1911 | Coyne | 126/137 |
| 1,424,584 | 8/1922 | Nelson et al. | 126/137 |
| 1,444,903 | 2/1923 | Cobb | 126/120 |
| 1,546,503 | 7/1925 | Meier | 126/126 |
| 2,398,240 | 4/1946 | Merryweather et al. | 126/138 |

*Primary Examiner*—Ronald C. Capossela
*Attorney, Agent, or Firm*—McCormick, Paulding & Huber

[57] ABSTRACT

A conventional fireplace opening is closed off by a flat steel plate the size of which will cover conventional fireplace openings. Two clamps permit the plate to be secured to the fireplace lintel. A firebox is bolted to the front of the plate so that it is located entirely within the room, rather than in the fireplace opening. An access door is provided at the front of the firebox, and a draft opening below the door provides control of inlet air to the fire. A damper valve is located in an exhaust opening at the rear of the firebox to provide control of the products of combustion within the firebox.

10 Claims, 3 Drawing Figures

FIREPLACE STOVE

SUMMARY OF INVENTION

This invention relates generally to fireplace stoves, and deals more particularly with a stove designed to be conveniently located in front of the fireplace, with the fireplace opening being closed off as a result of the unique backplate construction for the stove.

The fireplace stove incorporating the present invention provides for sealing off the fireplace opening by means of a plate, which plate also serves to support a generally rectangular firebox structure located within the room to be heated. A front access door is provided in the firebox structure as is an air inlet door for controlling the rate of burning within the firebox. An exhaust opening is provided at the rear of the firebox structure and communicates with an opening in the plate with a damper valve being provided in the opening to control the products of combustion produced by the fire. The fireplace may or may not have a conventional damper valve, and it is a feature of the present invention that this valve may be left open continually once the fireplace stove is installed. The installation procedure is facilitated by a pair of clamping devices which secure the backplate to the lintel portion of the fireplace opening, these devices being so designed as to accommodate fireplace openings of various sizes. Means is provided for regulating the size of both the inlet and outlet openings of the firebox whereby the rate of burning of the fire within the firebox structure is closely controlled.

Among the many advantages of the unique design disclosed and claimed herein are first the rendering of the fireplace considerably more efficient from the point of view of providing heat to the room where the fireplace is located. Secondly, the simple construction for the fireplace or stove disclosed herein obviates the need for complicated chambers or passageways for handling the flow of air into the fireplace and back into the room during the process of drawing heat from the source, namely the fire, in order to warm the air within the room. The fireplace stove of the present invention serves as a simple radiating device which also warms the air by convection as a result of the location for the firebox being spaced above the floor of the room and being located within the confines of the room itself rather than being relegated to an inefficient position within the fireplace opening. The design also obviates the need for any unsightly flue of the type normally provided in a stove of the space heater type.

DETAILED DESCRIPTION

Figure 1:
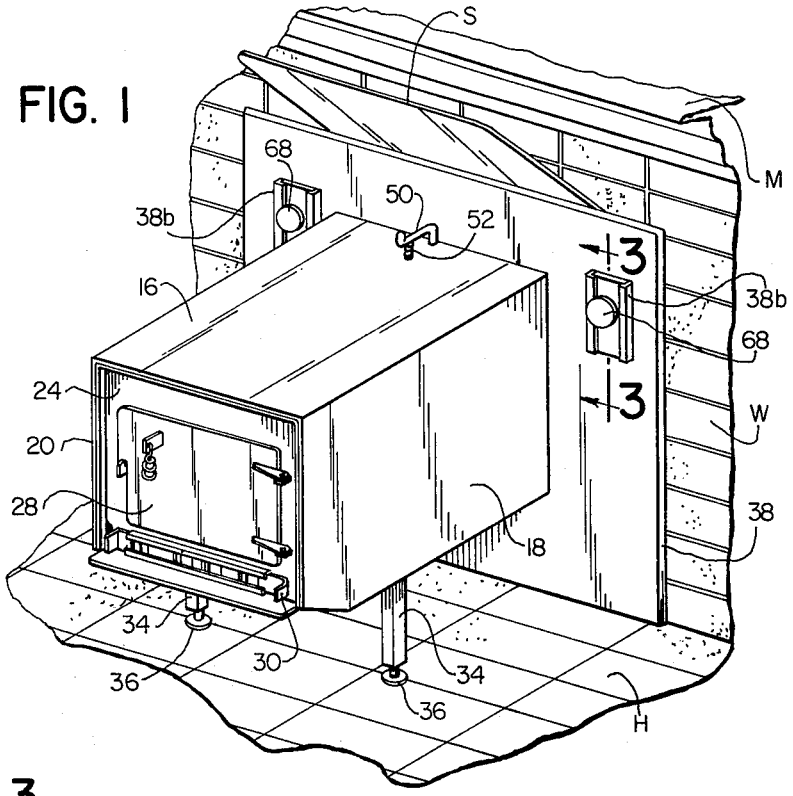
FIG. 1 is a perspective view illustrating a fireplace stove constructed in accordance with the present invention, the stove being installed in a conventional fireplace opening.
Figure 2:
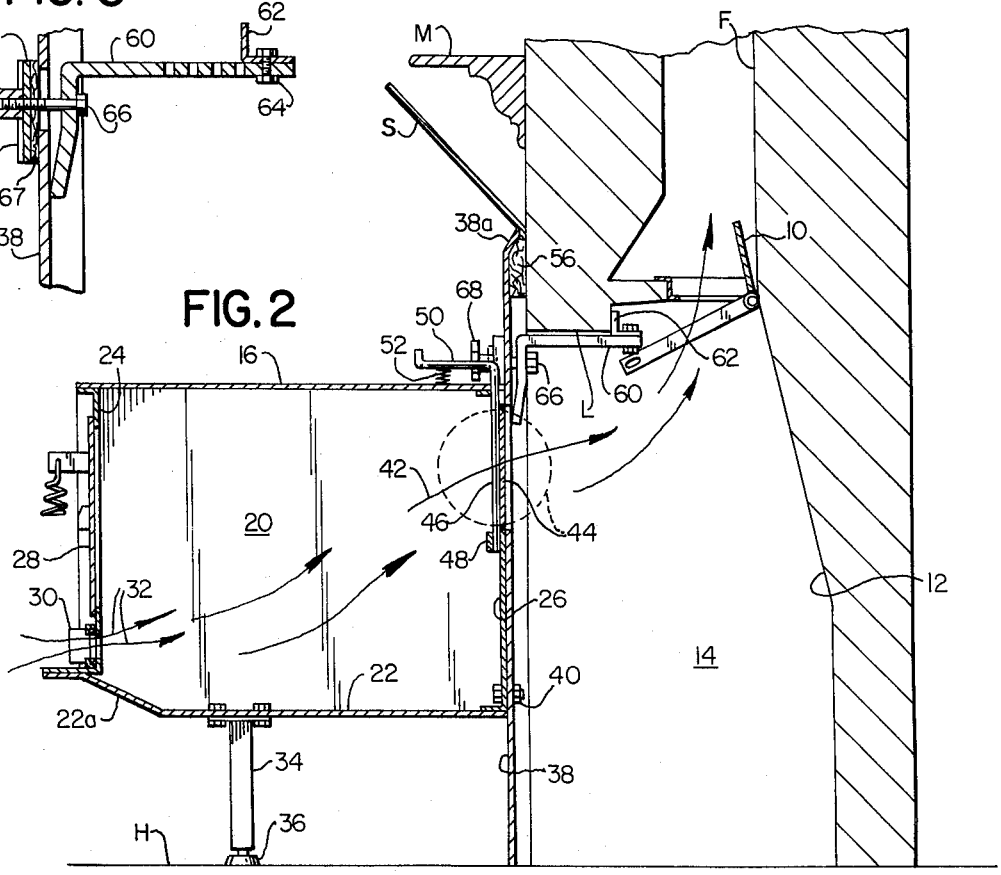
FIG. 2 is an elevational view taken vertically through the middle of FIG. 1 structure, and also illustrates the conventional fireplace opening.

Turning now to the drawing in greater detail, FIG. 1 shows a conventional fireplace wall W of the type normally fabricated of brick veneer, and defining a fireplace opening (best shown in FIG. 2) and a horizontally extending hearth H which may comprise the floor of the room to be heated, or which hearth may be raised above the floor as is conventional practice in the construction of some fireplaces. FIG. 2 shows the chimney construction, and the typical chimney includes at least one flue F in which a conventional manually operated damper 10 may be provided so as to permit the closing of the flue opening when the fireplace is not in use. As shown in FIG. 2 the fireplace opening is further defined by a lintel L or arch, and the fireplace opening includes a rear wall 12 sometimes fabricated from a refractory brick so as to withstand the high temperatures normally established in the area 14 of the fireplace opening when the fireplace is used conventionally.

Still with reference to FIG. 1 a conventional mantel M may be provided above the fireplace opening, and if so a shield S may be utilized to preclude excessive heat from reaching the underside of said mantel M.

The present invention seeks to move the source of heat out into the room, but to utilize the existing flue F in the chimney for carrying away the products of combustion from the fire. In addition, the fireplace opening is sealed off by means of a backplate 38 in order to further improve the thermal efficiency of the overall combination.

The present invention contemplates the provision of a firebox structure just above the hearth or floor H and located in front of the fireplace opening described above. As best shown in FIG. 1 said firebox structure comprises a hollow rectangular sheet metal structure which includes a generally U-shaped member defining a horizontally extending top 16, and parallel vertically extending sidewalls 18 and 20. A bottom wall 22 is welded between the lower side edges of the sidewalls 18 and 20, and includes an upturned front portion **22*a* which cooperates with the front edges of the top and sidewalls to receive a generally channel shaped, or flanged front wall plate 24. A similarly flanged rear wall plate 26 is provided adjacent the backplate 38** as best shown in FIG. 2.

The front wall 24 defines an access opening which is fitted with a hinged access door 26, and immediately below the door, in the front wall 24, there is provided a draft or air inlet opening structure adapted to be opened or closed by sliding a horizontally movable valve element or plate 30. Alignable openings in the plate element 30, and in the front wall 24 provide a convenient means for metering the flow of air into the firebox structure as suggested by the arrows 32, 32.

The firebox structure is supported above the hearth H on two depending posts 34, 34 each of which posts is individually adjustable in height by a conventional threaded foot member 36, 36 respectively. The fireplace structure is also supported at its rear, or inner wall by the vertically extending backplate 38, which plate is adapted to completely cover the fireplace opening and to be clamped into the fireplace opening by means associated with the lintel L and illustrated in detail in FIG. 3. The rear wall 26 of the firebox structure and the backplate 38 are mounted adjacent one another, and more particularly are bolted to one another by bolt means, one of which is shown at 40 in FIG. 2. Preferably a plurality of such bolts are provided in order to securely anchor the firebox structure to the backplate 38. Still with reference to the backplate 38 and the rear wall 26 of the firebox structure, both of these members are provided with aligned exhaust openings, which openings serve to define an exhaust port for allowing the products of combustion to pass rearwardly out of the firebox and into the fireplace opening, and thence upwardly through the flue F. This exhaust opening is fitted with a damper valve 44 supported on a generally vertically extending shaft 46 the lower end of which shaft is rotatably supported in a bracket 48 provided for this purpose on the inside surface of the rear wall 26. The upper end of the shaft 46 extends through an opening in the upper wall 16 of the firebox structure, and this upper end portion of the shaft is provided with a ninety degree bend to define a handle means 50 accessible from outside the firebox structure to permit adjusting the position of the damper valve element 44 in its associated opening. A spring 52 is preferably provided between the handle means 50 and the upper surface of the top wall 16 to hold the valve element 44 in its selected position. Still with reference to the backplate 38 the upper marginal edge and the vertically extending side edges of the plate 38 are bevelled, as best shown at 38*a* in FIG. 2, and further, a double faced adhesive tape is applied as shown in FIG. 2 in order to receive a fiberglass strip and thereby seal off the fireplace opening from the room to be heated.

Figure 3:
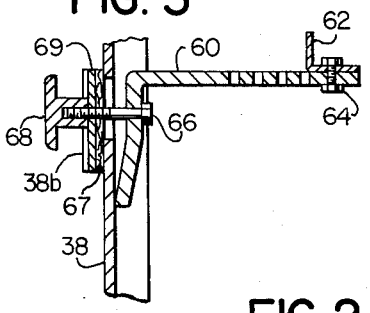
FIG. 3 is a vertical sectional view taken to a somewhat larger scale and illustrates the clamping devices used to secure the backplate at the front of the conventional fireplace opening, being taken generally on the line 3—3 of FIG. 1.

Turning next to a description of the clamping means for securing the plate 38 in the fireplace opening, said means comprise two in number and each includes an L-shaped bracket 60 best shown in FIG. 3. One leg of each bracket is generally vertically oriented and adapted to abut the inside surface of the plate 38. The other leg of the L-shaped bracket 60 extends inwardly and horizontally below the fireplace lintel L as best shown in FIG. 2, with an abutment member being carried by the inner end portion of this horizontal leg for engagement with the rear face of the lintel. Preferably, said abutment member comprises an angle iron 62 adjustably bolted to the horizontally extending leg of the bracket 60 by means of a screw 64. This adjustability allows the clamping means to accommodate lintels of various depth. Bolt means in the form of a screw 66 is welded to the downwardly extending leg of each bracket 60, and extends forwardly through a vertically elongated slot in the plate 38 as best shown in FIG. 3.

Nut means is provided on the forwardly projecting threaded end of bolt means 66 to clamp the abutment 62 against the rear face of the lintel L. Said nut means preferably comprises a hand knob 68. A cover plate 69 is also provided on screw 66 and serves to hide the vertically elongated slot in the backplate 38, and also serves to support a small fiberglass pad 67. The cover plate 69 and pad 67 are preferably provided in a channel 38*b* welded to the plate 38.

I claim:

1. A fireplace stove comprising a generally planar flat plate of such a size that marginal portions are adapted to overlie the sides of a fireplace opening, a hollow rectangular firebox structure which includes a horizontal top and vertically extending side walls, said firebox structure having a rear wall supported by said plate and having a bottom wall and a front wall defining an access opening, an access door in said opening, said front wall further including an air inlet opening adjacent the lower portion of said front wall, a side valve for metering flow of inlet air, said plate defining an exhaust opening adjacent the upper portion of the rear wall of said firebox structure, a damper valve is said exhaust opening, and handle means accessible from outside said firebox to adjust the position of said damper valve.

2. The stove according to claim 1 further comprising clamping means for securing said plate in said fireplace opening, said clamping means including an L-shaped bracket one leg of which L is vertically oriented and abuts the inner surface of said plate and the other of which L legs extends inwardly and horizontally below the fireplace lintel, an abutment member carried by said horizontal leg for engaging the rear of the lintel, and anchor bolt means for securing said L-shaped bracket to said plate, said bolt means extending through a vertically elongated slot in said plate to provide a degree of vertical adjustment of said clamping means to accommodate lentils of various height.

3. The stove according to claim 2 wherein said clamping means comprises two such L-shaped brackets, associated lintel engaging abutments, and bolt means, said two clamping means arranged in a symmetrical fashion one on either side of said firebox structure.

4. The stove according to claim 3 further comprising adjustable support legs located intermediate the front and rear walls and depending from said bottom wall to cooperate with said plate in supporting said rectangular firebox structure.

5. The stove according to claim 1 wherein said rear wall of said firebox structure abuts said plate and bolts secure said rear wall to said plate to support said firebox structure, said exhaust opening being defined in said rear wall and in said plate, and a vertical shaft supporting said damper valve for movement between a closed position in the said exhaust opening and an open position generally perpendicular to the plane of said exhaust opening, said shaft having an upper end defining said handle means.

6. A fireplace stove comprising a generally planar flat plate having a size and shape adapted to overlie and seal off a conventional fireplace opening, a rectangular firebox structure supported by said plate and having a bottom wall spaced above the lower edge of the plate, said firebox structure having a horizontal top wall parallel the bottom wall and serviceable as a stove top, a front wall with an access opening and an access door for said opening, an air inlet opening in said front wall, and means defining an exhaust opening in said plate providing communication between the hollow interior of said firebox and the inside of the fireplace.

7. The stove according to claim 6 further comprising clamping means for securing said plate in front of said fireplace opening, said clamping means including at least one L-shaped bracket having a horizontally extending leg below the fireplace lintel and a generally vertically oriented depending leg parallel said plate, abutment means carried by said horizontal leg for engaging the rear of the lintel and anchor bolt means extending through aligned openings in said depending leg and in said plate to clamp said plate against said fireplace opening.

8. The stove according to claim 7 wherein said anchor bolt means comprises two anchor bolts provided one on either side of said firebox structure, and said abutment means comprising two elements for engaging the rear of the lintel at horizontally spaced locations.

9. The stove according to claim 7 further comprising adjustable support legs located adjacent the front wall of the firebox structure to cooperate with said plate in supporting said firebox structure.

10. The stove according to claim 9 wherein said firebox structure includes a rear wall, and bolts to secure said rear wall to said plate to support said firebox structure, said exhaust opening being defined in said rear wall and in said plate, a damper valve in said exhaust opening and a vertical shaft supporting said damper valve for movement between a closed position in the said exhaust opening and an open position generally perpendicular to the plane of said exhaust opening, said shaft having an upper end defining handle means.

* * * * *